US009481562B2

(12) United States Patent
Vandersteen

(10) Patent No.: US 9,481,562 B2
(45) Date of Patent: Nov. 1, 2016

(54) SUSTAINABLE BULK LIQUID DISPENSING DEVICE

(76) Inventor: Colleen Beth Vandersteen, East St. Paul (CA)

( * ) Notice: Subject to any disclaimer, the term of this patent is extended or adjusted under 35 U.S.C. 154(b) by 515 days.

(21) Appl. No.: 14/003,672

(22) PCT Filed: Mar. 26, 2012

(86) PCT No.: PCT/CA2012/050183

§ 371 (c)(1),
(2), (4) Date: Nov. 8, 2013

(87) PCT Pub. No.: WO2012/129686

PCT Pub. Date: Oct. 4, 2012

(65) Prior Publication Data

US 2014/0053950 A1 Feb. 27, 2014

Related U.S. Application Data

(60) Provisional application No. 61/467,775, filed on Mar. 25, 2011.

(51) Int. Cl.

| | |
|---|---|
| ***B65B 3/04*** | (2006.01) |
| ***B67D 7/78*** | (2010.01) |
| ***G07F 11/00*** | (2006.01) |

(Continued)

(52) U.S. Cl.

CPC ..... *B67D 7/78* (2013.01); *B67D 3/0038* (2013.01); *G07F 11/002* (2013.01); *G07F 13/025* (2013.01); *G07F 13/06* (2013.01)

(58) Field of Classification Search

CPC .... G07F 11/002; G07F 13/025; G07F 13/06; B67D 7/78; B67D 3/0038

USPC ..... 141/94, 98, 100, 104

See application file for complete search history.

(56) References Cited

U.S. PATENT DOCUMENTS

| | | | | |
|---|---|---|---|---|
| 4,108,221 | A * | 8/1978 | Freimuth | B65B 43/60 141/146 |
| 4,144,915 | A * | 3/1979 | Henderson | G01F 11/32 141/18 |
| 5,088,621 | A * | 2/1992 | Thompson | B67D 7/00 222/1 |

(Continued)

FOREIGN PATENT DOCUMENTS

| | | |
|---|---|---|
| DE | 202005011476 | 10/2005 |
| DE | 102008029835 | 12/2009 |

(Continued)

*Primary Examiner* — Nicolas A Arnett

(74) *Attorney, Agent, or Firm* — Ryan W. Dupuis; Kyle R. Satterthwaite; Ade & Company Inc.

(57) ABSTRACT

A bulk liquid dispensing system includes a plurality of dispensing devices for each dispensing a respective type of bulk liquid. Each device includes a primary tank of bulk liquid communicating with a nozzle for dispensing into a reusable container which may be provided by a customer. A secondary portable tank is interchangeably connected above the primary tank to ensure continued dispensing of liquid even as the secondary tank is interchanged. A payment system associates a debit amount with a dispensed fluid from each device resulting from a user selection and a cumulative total of the debit amounts is collected from the customer in a single transaction. The devices can be operated to dispense liquid in response to input of an identification code which is generated when the user prepays, for example through a web interface, a mobile application, a point of sale tool, or a tablet application.

18 Claims, 5 Drawing Sheets

(51) Int. Cl.

| | |
|---|---|
| ***G07F 13/02*** | (2006.01) |
| ***G07F 13/06*** | (2006.01) |
| ***B67D 3/00*** | (2006.01) |

(56) References Cited

U.S. PATENT DOCUMENTS

| | | | | | |
|---|---|---|---|---|---|
| 5,799,833 | A | 9/1998 | Green | | |
| 5,996,765 | A | 12/1999 | Ock | | |
| 6,082,246 | A | 7/2000 | Thorn | | |
| 7,624,922 | B2 * | 12/2009 | Brown | B67D 7/02 | 235/381 |
| 7,963,439 | B2 * | 6/2011 | Brown | B67D 7/02 | 235/381 |
| 8,365,991 | B2 * | 2/2013 | Brown | B67D 7/02 | 235/381 |
| 2002/0030102 | A1 * | 3/2002 | Brown | B67D 7/02 | 235/435 |
| 2004/0226994 | A1 * | 11/2004 | Brown | B67D 7/02 | 235/381 |
| 2005/0092389 | A1 * | 5/2005 | Mazur | G07F 11/44 | 141/100 |
| 2005/0285716 | A1 | 12/2005 | Denison | | |
| 2006/0026987 | A1 | 2/2006 | Wetherbee | | |
| 2008/0052176 | A1 * | 2/2008 | Buchheit | G06Q 20/02 | 705/17 |
| 2011/0100506 | A1 * | 5/2011 | Zabludovsky-Nerubay | B65D 75/5883 | 141/94 |
| 2011/0247721 | A1 * | 10/2011 | Brown | B67D 7/02 | 141/1 |

FOREIGN PATENT DOCUMENTS

| | | |
|---|---|---|
| GB | 810371 | 3/1959 |
| GB | 2144397 | 3/1985 |
| WO | 0006451 | 2/2000 |
| WO | 0186515 | 11/2001 |
| WO | 2006053456 | 5/2006 |
| WO | 2010116544 | 10/2010 |

* cited by examiner

SUSTAINABLE BULK LIQUID DISPENSING DEVICE

This application claims the benefit under 35 U.S.C. 119(e) of U.S. provisional application Ser. No. 61/467,775, filed Mar. 25, 2011.

FIELD OF THE INVENTION

The present invention relates to a device for vending a prescribed volume of liquid to a customer from a bulk liquid tank, and more particularly the present invention relates to a system including a plurality of bulk liquid tanks arranged to dispense bulk liquid through respective nozzles in association with a common payment system arranged to debit a customer for each prescribed volume of liquid dispensed from the tanks.

BACKGROUND

Automatic liquid dispensing through the use of dispensing machines is well known. Such machines include water machines which dispense water and for a price determined by the operator of the dispensing machine. In actual operation, a customer might insert coins or currency equaling or exceeding the price of the desired item and then press a selection button or buttons to select the liquid quantity. The liquid dispensing machine dispenses the liquid quantity and returns the customer's change, if any is owed. Such machines are highly advantageous, but suffer from a number of drawbacks. For example, the hydro electric power required to operate each water pump and noise pollution of high number of water pumps operating in one facility for each dispenser is not eco-friendly efficient. Also payment is typically limited to credit card, coin operation, debit card or pre-paid card.

Some examples of various attempts for vending liquids from a bulk source of liquids are described in prior U.S. Pat. No. 7,451,015 by Mazur et al.; U.S. Pat. No. 7,681,605 by Emes et al.; U.S. Pat. No. 5,685,435 by Picioccio et al.; and U.S. Pat. No. 2,021,544 by Crown.

Known prior devices relating to vending of liquids are typically limited to specific types of liquids. In general, only a single tank is provided for each liquid type so that the device is not operable for dispensing when the single tank is being refilled with bulk liquid. Refilling however can be time consuming and awkward for large volumes of bulk liquids in many applications where dispensing of bulk liquids in vending environment is desired. Furthermore, the typical construction of a vending device for a bulk liquid involves a tank supported substantially at ground level requiring additional pumps and consumption of unnecessary power to pump the liquid upwardly to the dispensing nozzle for dispensing to the customer.

SUMMARY OF THE INVENTION

According to one aspect of the invention there is provided a bulk liquid dispensing device for use with a portable liquid container having a discharge opening, the device comprising:

a main frame;

a primary tank fixed on the main frame having a discharge opening at a bottom end and an inlet opening at a top end and being arranged for containing a bulk liquid therein;

a dispenser nozzle supported below the primary tank in communication with the discharge opening of the primary tank;

a control valve in series with the dispenser nozzle so as to be arranged to control dispensing of the bulk liquid from the primary tank through the dispenser nozzle;

a secondary tank support arranged to support the portable liquid container thereon above the primary tank; and a liquid conduit arranged for sealed connection with the discharge opening of the portable liquid container at an upper end and arranged for sealed connection with the inlet opening of the primary tank at a lower end so as to be arranged for communicating bulk liquid from the portable liquid container to the primary tank;

the secondary tank support and the liquid conduit both being arranged such that the portable liquid container is readily separable from the primary tank and interchangeable with a different portable liquid container of like configuration.

By providing both a primary tank which is stationery and a secondary tank which is readily portable and interchangeable, the refilling operation involves simply replacing the portable tank so that the vending device remains operational for vending to customers while refilling and while interchanging the portable tank. Accordingly, a very large capacity is possible without the inconvenience of lengthy refilling times.

Furthermore, by supporting the primary tank above the dispensing nozzle and the secondary tank above the primary tank, the dispensing can be accomplished by gravity feed only freely through two levels of tanks so as to be more environmentally friendly as no power is required for pumping the liquid while dispensing to a customer.

The devices are also readily adaptable to being supported in series with one another in communication with a common payment system allowing a collective purchase of bulk liquids from several different dispensers by assigning each customer with an identification and arranging each dispensing device to debit the identification stored on the payment system as a prescribed portion of liquid is dispensed from each different tank selected by the customer.

Preferably the liquid conduit is arranged for unrestricted communication of liquid from the portable liquid container to the primary tank.

There may be provided a vent line in communication with the primary tank having an open free end arranged to be supported higher in elevation than the portable liquid container supported on the secondary tank support.

Preferably the primary tank is arranged to controllably dispense liquid therefrom through the control valve when the portable liquid container is separated from the primary tank.

The portable liquid container may be generally rectangular in shape and adapted to be handled with pallet moving equipment.

Preferably a shut-off valve is connected in series with the liquid conduit.

Preferably the portable liquid container includes a vent having an exterior opening adjacent a top end of the portable liquid container.

The primary tank may be arranged for communication with the portable liquid container and the dispenser nozzle such that liquid is arranged to be dispensed from the portable liquid container to the primary tank and from the primary tank through the dispenser nozzle solely under force of gravity.

Preferably the portable liquid container and the primary tank each have a volume of at least 100 liters.

In some instances there is provided a container receiving area below the dispenser nozzle arranged to support an auxiliary container therein and a container sensor in the container receiving area so as to be arranged to determine a volume of the auxiliary container in the container receiving area.

The dispenser nozzle may include a fill sensor thereon which is arranged to close the control valve responsive to detection by the fill sensor that the container is full. A flow meter may then be arranged to determine a prescribed volume of liquid dispensed from the dispenser nozzle. In this instance a payment system is arranged to debit a customer a debit amount corresponding to the prescribed volume of liquid dispensed as determined by the flow meter.

A lift system may be supported on the main frame which is arranged to lift a portable liquid container from a ground level to a working position above the primary tank.

When a plurality of bulk liquid dispensing devices of like configuration are arranged in a row, there may be provided a conveyor system arranged for conveying portable liquid containers along the row of devices at an elevation above the primary tanks and a common lift system arranged to lift portable liquid containers onto the conveyor system. A walkway may also be provided extending along the row at an elevation above the primary tanks which is arranged to support a user walking therealong.

The container receiving area below the dispenser nozzle may include a door arranged to enclose the container receiving area with an auxiliary container supported therein. In this instance the control valve may be arranged to only dispense liquid therethrough when the door is closed.

When there is provided a container supporting surface below the dispenser nozzle upon which a customer container is arranged to be supported, preferably the dispenser nozzle is adjustable in height relative to the container supporting surface.

A guard assembly including a guard member may be supported at a location spaced below a bottom end of the dispenser nozzle which includes a locator opening in alignment with the dispenser nozzle thereabove. The guard member is thus arranged to engage a top end of the customer container about a neck opening of the customer container so as to being arranged to guide alignment of the dispenser nozzle with the neck opening while preventing contact of the dispenser nozzle with the customer container.

Preferably the guard assembly and the dispenser nozzle are movable together relative to the container supporting surface.

The guard assembly preferably includes a tubular housing extending upwardly from the guard member about the dispenser nozzle.

When a plurality of other bulk liquid dispensing devices of like configuration are located at a common location, preferably there is provided a common payment system in communication with all of the bulk liquid dispensing devices so as to be arranged to associate a debit amount with the prescribed amount of bulk liquid of each user selection and to debit from a customer a common debit amount corresponding to a cumulative total of the debit amounts.

According to another aspect of the present invention there is provided a bulk liquid dispensing system for dispensing bulk liquids into respective portable liquid containers, the system comprising:

a plurality of bulk liquid dispensing devices, each device comprising:

a main frame;

a primary tank fixed on the main frame having a discharge opening at a bottom end and an inlet opening at a top end and being arranged for containing a bulk liquid therein;

a dispenser nozzle in communication with the discharge opening of the primary tank; and a control valve in series with the dispenser nozzle so as to be arranged to control dispensing of a prescribed amount of bulk liquid from the primary tank through the dispenser nozzle in response to a user selection; and a common payment system in communication with all of the bulk liquid dispensing devices so as to be arranged to:

associate a debit amount with the prescribed amount of bulk liquid of each user selection; and debit from a customer a common debit amount corresponding to a cumulative total of the debit amounts.

In one embodiment, the payment system comprises a plurality of customer identifications associated with respective customers and the payment system is arranged to associate the respective debit amount to the customer identification of the customer when the prescribed amount of bulk liquid is dispensed from each dispensing device in response to the associated user selection being made at the device.

In a more preferred embodiment, the payment system comprises a computer implemented selection tool arranged to: i) receive the user selections from the customer in which each user selection comprises a type of bulk liquid and the prescribed amount of bulk liquid associated therewith; and ii) assign a unique identification to the customer in association with the user selections in response to payment of the common debit amount by the customer. In this instance, preferably each bulk liquid dispensing device is associated with one respective type of bulk liquid and includes a user interface arranged to receive unique identifications input from the customers. The dispensing devices are thus arranged to dispense the prescribed amount of bulk liquid in response to receipt of the associated unique identification corresponding to the type of bulk liquid associated with that dispensing device.

The computer implemented selection tool may further comprise an Internet interface permitting a customer to make user selections remotely from the dispensing devices through an internet connection, or a computer application which is arranged to be executed on a smartphone or a tablet in communication with the common payment system.

Preferably the computer implemented selection tool is arranged to generate a single unique identification associated with all of the user selections of the respective common debit amount.

Some embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
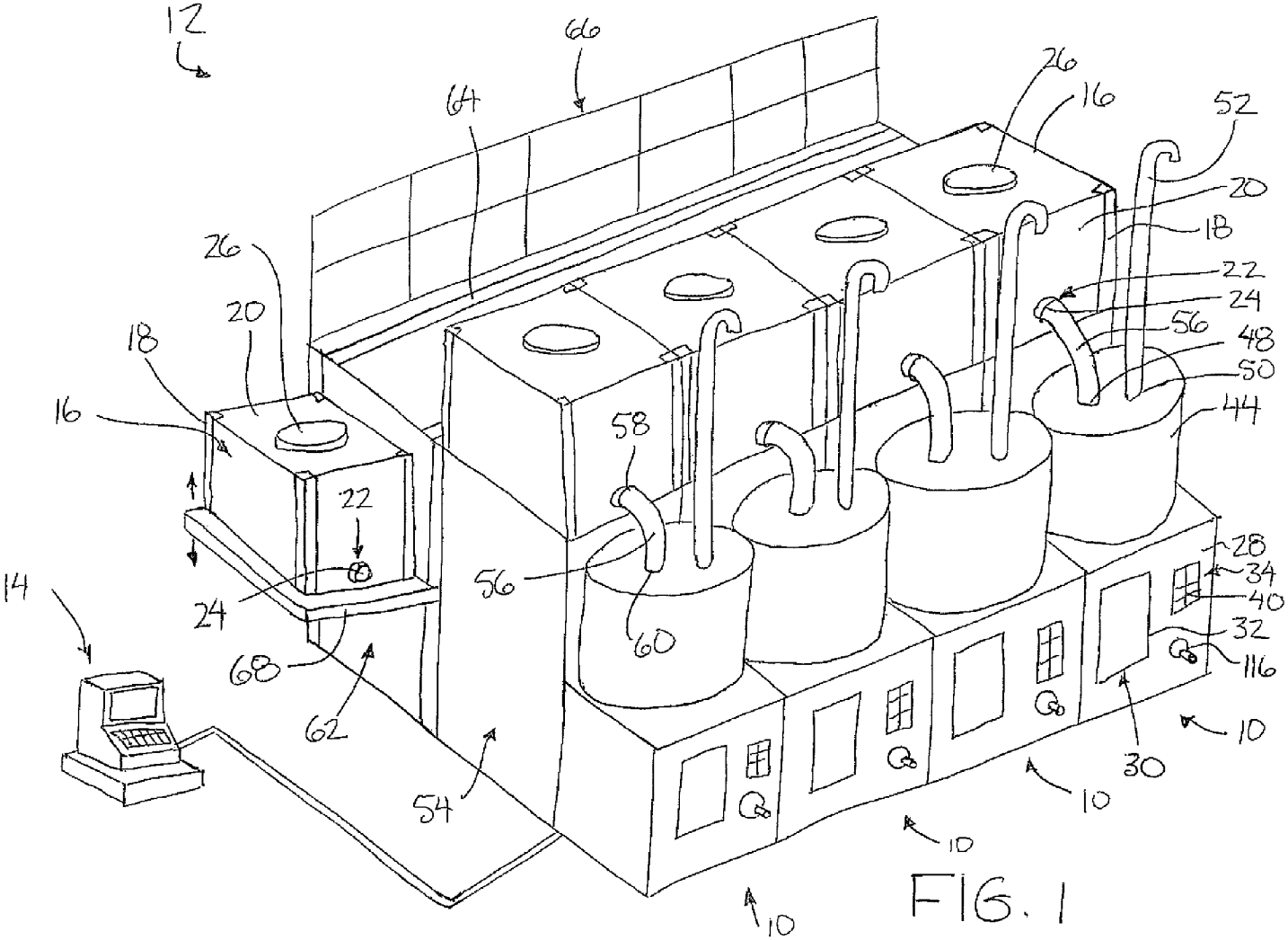
FIG. 1 is a perspective view of a bulk liquid dispensing system comprising a plurality of bulk liquid dispending devices.
Figure 2:
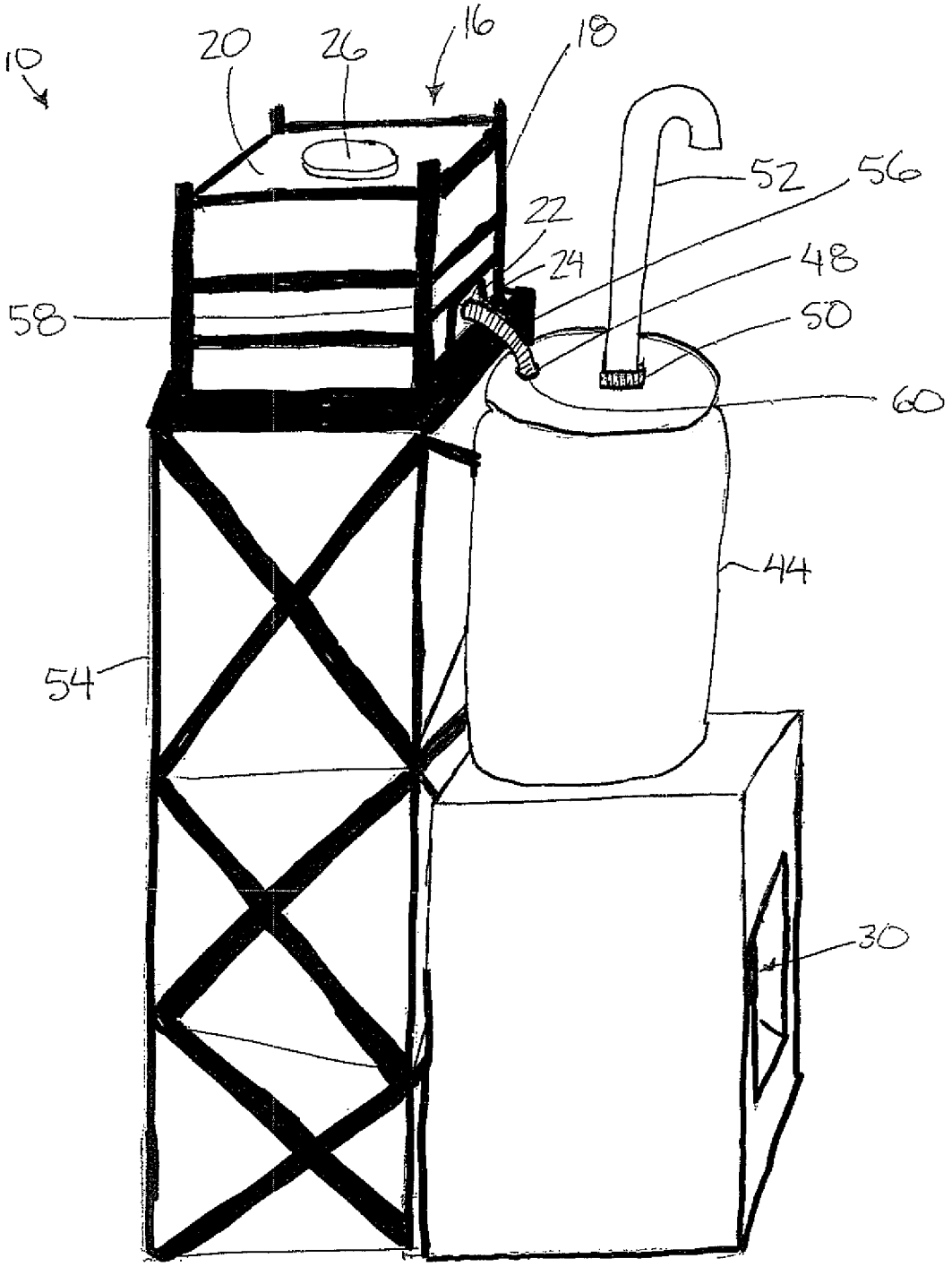
FIG. 2 is a perspective view of a single bulk liquid dispensing device.
Figure 3:
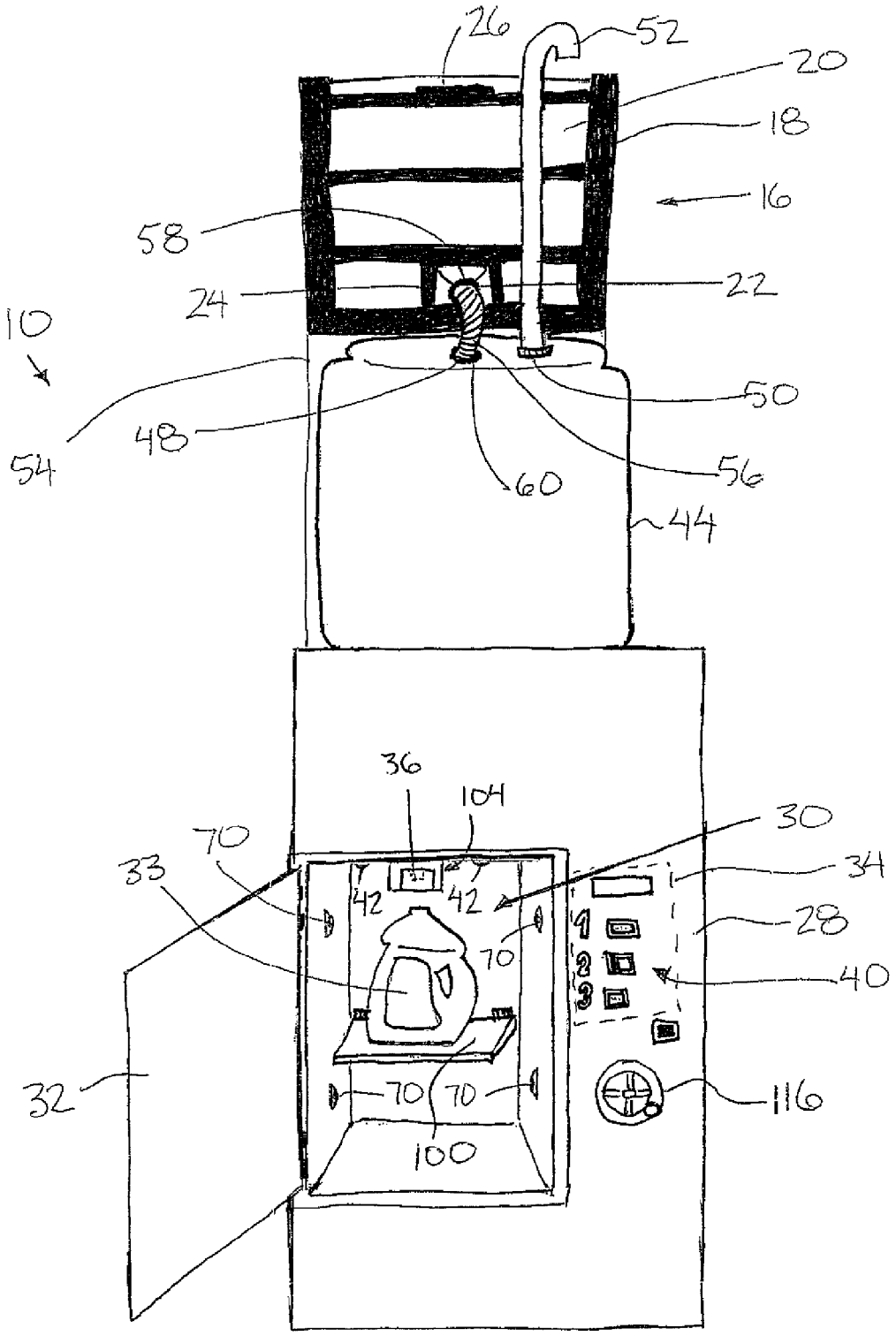
FIG. 3 is a front elevational view of the bulk liquid dispensing device of FIG. 2.
Figure 4:
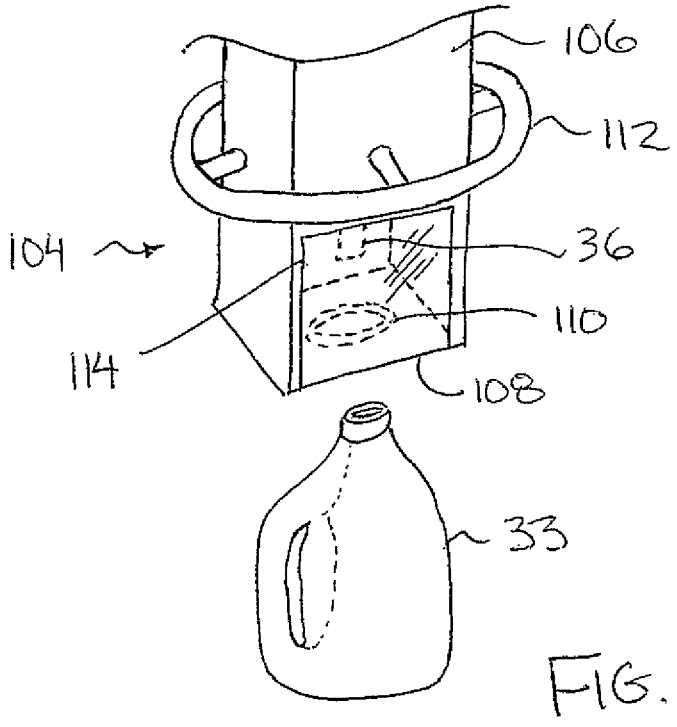
FIG. 4 is a perspective view of a guard assembly about the dispenser nozzle.

Referring to the accompanying figures, there is illustrated a bulk liquid dispensing device generally indicated by reference numeral 10. A plurality of the devices 10 are typically supported in one or more rows within a common environment for dispensing a respective liquid from each one of the devices to customers within the common environment. Examples of the common environment where the system may be located include a retail environment, a customer based and internal user environments, or employee based environments such as a warehouse, institutes, hospitals, laboratories, resorts and hotels, and various commercial applications, including pool products or cleaning products for example.

All of the dispensing devices 10 collectively form a bulk liquid dispensing system 12 offering customers a variety of bulk liquids to be purchased and dispensed into customer supplied containers for receiving the bulk liquid. The bulk liquid dispensing system 12 works in conjunction with a collective payment system 14 allowing customers within the common environment of the system 12 to make a single purchase of several prescribed volumes of liquid dispensed from a plurality of different ones of the devices 10.

The system 12 works in cooperation with any one of various types of commercially available configurations of portable liquid containers 16. In the illustrated embodiment, each portable liquid container comprises a support frame 18 formed of rigid frame members having rectangular sides assembled in a cubic configuration so as to be readily stackable with other frames of like portable containers 16. The rigid frame members form a cage for supporting a plastic tank 20 therein which substantially fills the generally cubic interior volume of the frame 18. The stackable frame includes a base adapted for receiving the forks of pallet handling equipment thereunder such that the portable liquid container can be readily handled by conventional pallet handling equipment.

The plastic tank 20 is suitably arranged for containing a bulk liquid therein and may have a capacity in the range of 100 to 1500 liters, or more preferably near 1250 liters for example. The tank 20 of each container 16 includes a discharge opening 22 at the bottom end of the tank in communication with a respective shut off valve 24. The tank of each container 16 further includes an inlet opening 26 at the top end through which the tank is arranged to be filled. A vent opening may be provided in the lid covering the inlet opening 26 to permit venting to the exterior when the vent opening is opened. An exterior opening of the vent opening is located above the top of the tank so that liquid does not spill out of the vent opening but the vent opening instead serves to allow air to enter the tank through the top end as the liquid within the tank is dispensed through the discharge opening 22 at the bottom end. In some embodiments no vent opening is required in the portable liquid containers 16.

Each device 10 comprises an exterior housing 28 surrounding a main frame providing structural support to the device. A container receiving area 30 is located within the interior of the housing so as to be accessible through an opening in the front wall of the housing. The container receiving area 30 is enclosed on all interior sides by respective walls and includes a door 32 at the front wall of the housing for selectively spanning the opening in the front wall through which the container receiving area is accessed. A customer is thus permitted to open the door 32 to place their own provided container 33 within the receiving area 30 to receive liquids dispensed from the device. Typically the door 32 is connected to a controller 34 of the device such that any dispensing of liquid into the user supplied container 33 within the area 30 is prevented until the door 32 is closed for enclosing the container within the area 30.

The container receiving area 30 includes a dispenser nozzle 36 supported in the top wall of the receiving area 30 to allow alignment of the nozzle with a user supplied container 33 therebelow such that liquid is arranged to be dispensed from the nozzle 36 into the container.

The container dispensing area includes a generally horizontal supporting surface 100 upon which a portable customer container 33 can be supported. To accommodate different sizes of containers the dispenser nozzle 36 is vertically adjustable in height relative to the support surface 100. While the surface may be movable relative to the main frame, in the illustrated embodiment, the nozzle 36 is adjustable relative to surface 100 which is fixed relative to the frame.

In this instance, a height sensor can be associated with the dispenser nozzle which is arranged to determine the size of the customer container and thus the prescribed amount of bulk liquid to be dispensed to fill the container based on the height as determined by the height sensor.

In yet further embodiments, various scanning technologies, for example imaging sensors, can be used to scan a customer container located within the container area in a manner which allows the system to determine the volume of the container automatically, for example by mathematically modeling the container from the imaging data received by the imaging sensors. The prescribed amount of liquid to be dispensed by the control valve then corresponds to the determined volume of the customer container in this instance.

Figure 5:
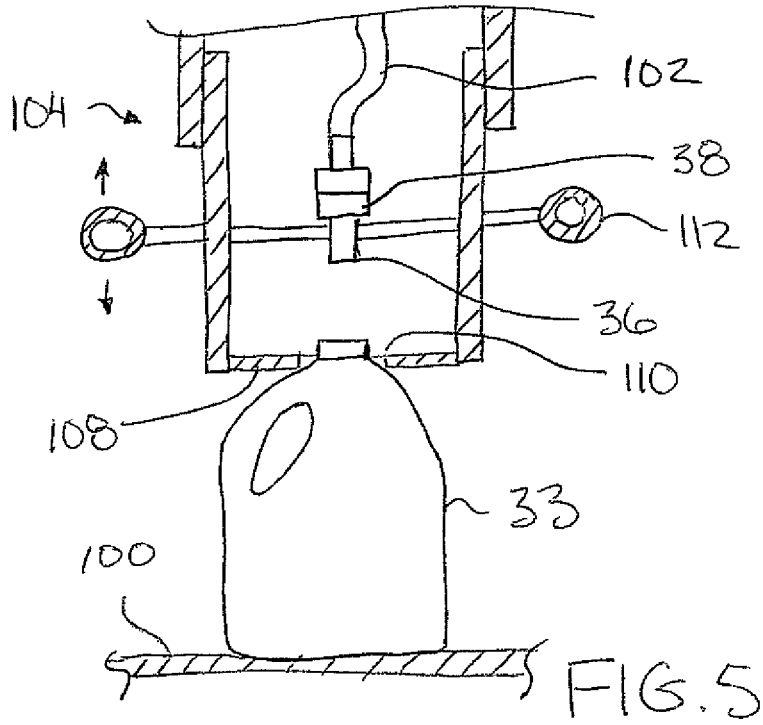
FIG. 5 is a vertical cross section through the dispenser nozzle and guard assembly.

As best shown in FIG. 5, to connect the nozzle for receiving bulk liquid, a discharge conduit 102 communicates at a top end with a source of bulk liquid above the nozzle and at a bottom end with the nozzle 36 as described in further detail below. In the illustrated embodiment the conduit 102 is a flexible hose to permit movement of the nozzle 36 relative to the housing, however other conduits, such as telescoping conduits with pressure seals between adjacent sections may be permitted.

A guard assembly 104 is provided about the nozzle which includes a tubular housing 106 of generally rectangular cross section surrounding the discharge conduit 102 and nozzle 36. The housing 106 extends vertically upwardly through the top wall of the container receiving area 30. A bottom end of the housing 106 is vertically slidable together with the nozzle relative to main frame. In the illustrated embodiment the housing 106 comprises a lower section which is slidable relative to an upper section such that the housing is telescopic as a height of the bottom end of the housing is vertically adjusted.

The housing 106 is enclosed at a bottom end by a horizontal guard member 108 in the form of a transparent plate having a central locating aperture 110 therein. The guard member 108 is spaced below the bottom end of the dispenser nozzle and the locating opening 110 is in vertical alignment with the dispenser nozzle thereof. The locating opening is of sufficient size that the neck of a customer bottle or container 33 can be received partially therethrough while the portion of the guard member surrounding the opening 110 engages a top end of the portable liquid container about the opening in the customer container. This allows guiding alignment of the opening of the container with the nozzle while preventing contact of the dispenser nozzle with the portable liquid container to prevent any contamination of product.

The guard assembly and the dispenser nozzle are movable together relative to the container supporting surface with the tubular housing extending upwardly from the guard member about the dispenser nozzle. Support arms extending between the nozzle and the housing may locate the nozzle centrally relative to the housing. In addition, a manual handle 112 may be supported about the housing by external support arms. This handle permits a user to manually position the guard member and nozzle relative to a container before beginning a filling operation of the container. The handle 112 on the housing 106 permits direct adjustment of the nozzle relative to the container by providing a handle which can be manually grasped by hands of a customer. Typically the housing is connected to a suitable brake member, damper assembly, or counter balance assembly such that the housing remains set at any elevation to which it is positioned by the user.

Typically the housing includes a transparent window portion 114 in a forward wall nearest to a door of the container receiving area adjacent the bottom end so as to be in alignment with the nozzle and to permit viewing of the upper surface of the guard member therethrough. The guard member 108 can also be transparent such that the neck and opening of the customer container is more readily visible and able to be aligned with the locating opening 110.

In some embodiments, an external actuator handle 116 can be mounted adjacent the control panel of the device separate and externally from the container receiving area. The actuator handle 116 may also be manually operated and connected by a suitable linkage to the tubular housing to control the elevation thereof, however in this instance, the elevation of the nozzle can be adjusted while the door of the container receiving area is closed as is required to begin a dispensing and filling operation.

The controller 34 of each device controls the dispensing of liquid through the nozzle by a respective control valve 38 connected in series with the nozzle 36 so as to be operated between respective open and closed conditions.

In some embodiments the nozzle 36 includes a fill sensor at the free end of the nozzle which is arranged to be inserted into the user supplied container 33 such that filling of the container ceases when the fill sensor detects that liquid within the container has reached the nozzle so as to indicate that the container has been substantially filled. In this instance, once dispensing has been initiated, the controller does not close the valve 38 until the fill sensor indicates that the container is full.

In other instances, the filling continues until a prescribed volume selected by the customer is reached at which point the valve is closed by the controller. In this instance a flow meter is typically connected in series with the dispenser nozzle 36 which is arranged for measuring a prescribed volume of liquid through the nozzle over a selected elapsed period of time.

In some embodiments, the prescribed volume of liquid to be dispensed into the user supplied container 33 is determined either by a selection input by a customer on a control panel 40 located on the front of the housing of the device. Alternatively suitable sensors 42 are provided within the interior of the receiving area 30 which are arranged to determine the size of the container 33 by identifying a bar code or symbol on the container or by scanning the container to determine the volume thereof.

According to a first embodiment of a common payment system, the controller 34 guides the user through a purchase using inputs from the user through the control panel 40 and prompts and displays being presented to the user also through the control panel. Once the volume of liquid to be dispensed into the user supplied container is determined the controller 34 debits a purchase amount corresponding to the prescribed volume of liquid dispensed to an account of the user. The user may make a purchase directly through the controller of the individual device 10, or alternatively the customer may include an identification stored on the common payment system 14 such that the controller of each device automatically debits the identification of the respective customer on the payment system after receiving the selected amount of liquid dispensed from each of the desired devices within the commercial area of the system 12. The user then completes a single purchase at an appropriate point of sale terminal in the usual fashion.

Each device stores liquid to be dispensed in a primary tank 44 which remains stationary and substantially fixed on the main frame of the device. The primary tank may have a volume in the range of 100-1500 liters, or more preferably near 1250 liters for example, and is typically supported fully above the dispenser nozzle 36 in elevation so as to permit discharging of liquid from the primary tank to the nozzle only by gravity feed. The tank 44 includes a tapered bottom discharging to a single bottom discharge opening.

The discharge conduit 102 communicates from the discharge opening of the primary tank to the control valve 38 and in turn to the dispensing nozzle 36. In normal operation the discharge opening of the primary tank remains fully open and in sealed communication with the control valve 38 and nozzle 36 such that the control valve is the only restriction to the flow of bulk liquid from the primary tank to the dispenser nozzle 36. An inlet opening 48 is provided at the top end of the primary tank for receiving bulk liquid therein for filling the tank 44. A vent opening 50 is also provided in the top of the primary tank 44 to allow entry of air into the tank as the liquid is dispensed from the tank. The vent opening 50 is typically connected in series with a vent stack 52 in sealed communication therewith in which the vent stack communicates the vent opening to an upper free end of the vent stack supported spaced above the top end of the primary tank in elevation.

The frame of each device includes a secondary tank support frame 54 which is rearward of the housing locating the receiving area 30 therein as well as being rearward of the primary tank stacked above the housing 28. The secondary tank support frame 54 is suitably arranged for supporting one of the portable liquid containers 16 therein such that the tank is readily separable therefrom and readily interchangeable with another container 16 of like configuration. The support frame 54 is arranged to support the container thereon such that the container is above the top end of the primary tank in elevation while the top end of the tank is below the open top end of the vent stack 52 which extends upwardly thereabove.

A liquid conduit 56 is arranged to be connected in series between an upper end 58 in sealed connection with the discharge opening 22 of the container 16 and a lower end 60 in sealed connection with the inlet opening 48 at the top end of the corresponding primary tank. In particular, the upper end of the liquid conduit is connected in series with the shut off valve 24 of the container such that the valve can remain closed while connecting the liquid conduit between the container 16 and the primary tank. Once the liquid conduit is in connection between the primary tank and the container functioning as a secondary tank the shut off valve is opened and remains open throughout the use of the container such that the liquid conduit permits an open end unrestricted flow of liquid communicating from the portable container 16 to the primary tank only by gravity feed therethrough. The liquid conduit 56 is similarly arranged for ready separation from the portable container 16 to permit ready separation and interchanging of the container 16 once emptied.

A handling system 62 is provided in the form of a conveyor 64 extending generally horizontally along the row of devices 10 at the height of the secondary tank support frames 54. The conveyor 64 is thus arranged for conveying portable containers 16 thereon along the row of devices 10 such that the containers can be readily displaced along the row from one end of the row and slid into place onto a respective one of the secondary tank support frames of any one of the devices 10 along the row. A walkway 66 may be provided along side the conveyor extending along the row of devices at the height of the portable containers 16 when supported on the secondary tank support frames 54 of the devices such that a user can readily walk along the row of the devices adjacent the conveyor for assisting in placement of the containers 16 from the conveyor to the respective secondary tank support frame 54 where the container 16 is supported in the working position thereof.

The handling system may further include a lift mechanism 68 which may be configured similarly to various pallet moving equipment such as a forklift. When providing the lift mechanism at one end of the conveyor, the mechanism can readily lift one of the portable containers from ground level where customers access the container receiving areas of the devices 10 to the height of the conveyor where the containers 16 are conveyed into their respective working positions on the respective secondary tank supports. In alternative arrangements conventional forklifts may be used to lift the portable containers 16 directly into position onto the respective secondary tank supports.

In use, the portable containers are supported on the respective support frames of the devices for connection by the liquid conduits 56 to the respective primary tanks which are in turn connected to the respective dispensing nozzles in a manner in which dispensing of liquid from the portable containers through the primary containers to the nozzle is accomplished only by gravity feed. By communicating the primary tank with a vent stack having an opening higher in elevation than the portable container 16 with an open end unrestricted communication of liquid from the portable container to the primary tank, a full container 16 can be connected to a full primary tank with the liquid conduit openly communicating therebetween without any concern of overflowing of liquid through the vent stack. Once the controller determines that the secondary tank in the form of the portable container 16 is empty, the controller provides suitable indication to the operators of the system to replace the portable container 16. The interchanging of the empty container 16 with a like container which is full can be accomplished while the primary tank remains in communication with the nozzle for dispensing any operation in the normal manner by customers.

According to the first embodiment of the payment system, the customer initially obtains a customer identification under the common payment system. Using the respective identification, the customer can interact with the control panel of any one of the devices in the system. At each device, the user selects a volume of liquid to be dispensed into their supplied container and a corresponding purchase amount is debited to their identification. Once all of the different liquids selected by the customer have been collected in respective containers, the customer then makes payment in the form of a single transaction at the checkout terminal which may simply be an automated terminal accepting a credit card payment for example or other form of suitable payment. One optional form of payment may include an application on a smart phone which allows a user to make a payment to the common payment system.

Figure 6:
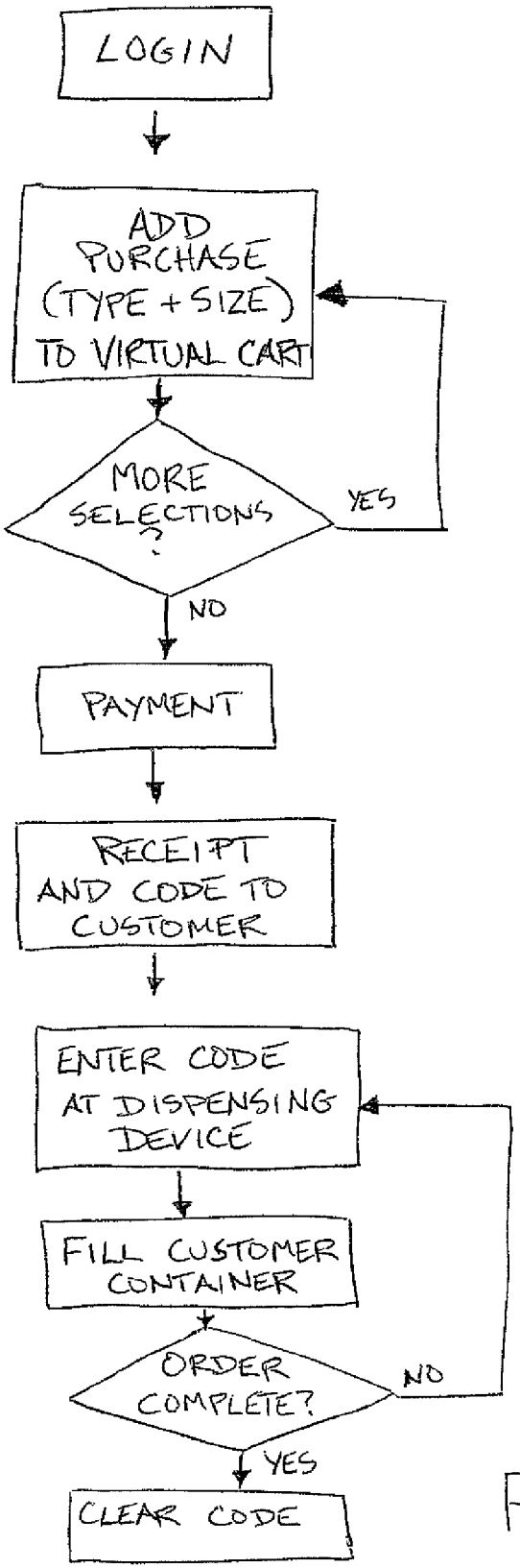
FIG. 6 is a schematic representation of a second embodiment of the common payment system of the bulk liquid dispensing system.

Turning now to FIG. 6, according to a second embodiment of the common payment system, the user may prepay for a collective group of user selections which are pre-ordered remotely from home or at the commercial location locating the dispensing device prior to any dispensing. The payment system includes a computer implemented selection tool. The tool can be website interface, a mobile application such as a smartphone or tablet application, or a point of sale tool which permits the user to make purchases with a virtual shopping cart. The tool receives user selections from the customer in which each user selection comprises a type of bulk liquid and the associated prescribed amount of bulk liquid for each type to be purchased. As in the previous embodiment, the common payment system is in communication with all of the bulk liquid dispensing devices and associates a debit amount or cost with each user selection dependent upon the type and amount of bulk liquid of each selection. In the second embodiment, the selection is done in a pre-order instead of at the respective dispenses devices as in the previous embodiment. A common debit amount corresponding to a cumulative total of the debit amounts for the various user selections is charged to the user in a single transaction, but this is done before dispensing.

To dispense the correct type and amount of liquid to each customer after payment, a unique identification or customer profile number is assigned to the customer in association with the user selections in response to payment of the common debit amount by the customer. For example the identification or code can be printed or otherwise presented on a receipt provided to the customer. The code is communicated to all of the dispensing devices. Typically each dispenses device is associated with only one respective type of bulk liquid to be dispensed therefrom. If the completed customer order includes a user selection with that type of bulk liquid, then the code becomes active and usable for dispensing the corresponding amount of bulk liquid from that device for only one use.

Each dispensing device includes a user interface arranged to receive the unique identifications input from the customers. When the unique ID or code is input, the device automatically responds by dispensing the prescribed amount of bulk liquid corresponding to the type of bulk liquid associated with that dispensing device.

As described herein, the bulk liquid dispensing system allows the customer to order from home or at the retail store. In preferred embodiments, the customer uses the computer implemented selection tool of the payment system which can either take the form of an Internet interface permitting a customer to make user selections remotely from the dispensing devices through an internet connection, or a computer application which is arranged to be executed on a smartphone (for example an iPhone) or a tablet in communication with the common payment system.

The consumer will thus have the convenience of starting a virtual shopping cart at home from a website associated with the dispensing system. Alternatively, the consumer has mobile access to the virtual shopping cart using an application executed on a smartphone or tablet to pre-order from home, at a retail store where the system is located, or any other desired location. Furthermore, the virtual shopping cart may be accessible at the location of the dispensing devices such as a retail store environment using a smartphone or tablet to make user selections. The payment can also be executed through the smartphone or tablet, or can be made at a checkout location within the retail environment.

In each instance the customer will make one or more user selections each including selecting the type of bulk liquid (e.g. laundry soap, dish soap, etc.) and the size of container (e.g. 710 ml, 1 liter, 4 liters, etc.) which designates the prescribed amount of bulk liquid to be dispensed. Each selection is added to the virtual shopping cart which is displayed to the user along with the cost or debit amount per item/selection and the cumulative total of the debit amounts. Customers will have a chance to remove any item if required before making a payment. The customer will then select the form of payment (e.g. debit, credit, cash, or smartphone such as iPhone payment by Near Field Communication, etc.). In response to a payment of the cumulative total in a single transaction, the customer is sent a receipt. Once the transaction is complete, the receipt is delivered according to a customer selection such as email, send to smartphone or print receipt. The receipt will have a single receipt code printed thereon which is a unique identification and is associated with all of the user selections of the respective shopping cart transaction. The code is then input at the control panel of the relevant dispensing devices at the retail location to start dispensing each item. As each item is dispensed, the code is no longer usable for that type of liquid being dispensed by deleting the code from a list of valid codes stored at each dispensing device which represents all of the orders which are pending. Once the order is complete the code is deleted from all dispensing devices and is no longer active.

For ongoing maintenance, operators of the system ensure that the empty portable containers are always replaced with full containers using the lift mechanism and conveyor system of the handling system 62. Individual devices 10 may be provided with respective wash cycles permitting the container receiving areas to be cleaned automatically if desired. In this instance, a plurality of auxiliary nozzles 70 are provided in the walls of the container receiving area 30 for rinsing the area when a wash cycle has been initiated. The wash cycle is particularly advantageous considering the large variety of liquids which can be dispensed through respective devices of the system.

Examples of liquids which can be dispensed include consumables and non-consumables as described in the following:

A) Cleaning supplies such as: laundry detergents, laundry stain removers, dish detergents, dishwasher detergents, dishwasher rinsing agents, bleach, multi-purpose cleaning solutions, all purpose cleaners, carpet/upholstery cleaning formulas, fabric fresheners, antibacterial solutions, liquid odor fresheners, glass/window cleaners, air fresheners, clogged drain removers, oven cleaners, eye glass cleaners, furniture oils, furniture polish, fabric softeners, anti-static solutions, calcium/lime/rust remover, various cream cleaners (VIM), various toilet bowl cleaners, antibacterial cleaners, fabric starch, fabric stain removers, floor polish;

B) Healthcare and hygiene supplies such as: shampoos, conditioners, skin cleansers, skin moisturizers, hand lotions, body lotions, face creams, face lotions, bath oils, bubble bath, body oils, liquid hand soap, toothpaste, tooth gel, hand sanitizers, hand washes, body washes, hairsprays, hair styling gels, hair mousse, eye cream, eye lotions, eye cleansers, eye makeup removers, rubbing alcohol, isopropyl alcohol, suntan lotions, sunscreen lotions, tanning lotions, liquid makeup, nail polishes, nail polish removers, hair coloring, body oils, by gels, shaving cream, shaving lotions, shaving gel, colognes, perfumes, tooth whiteners, mouth washes;

C) Cooking supplies such as: cooking oils, salad oils, fruit sauces, vegetable sauces, tomato sauces, pizza sauces, salsas, vinegars, various soya sauces, various extracts;

D) Condiments such as: ketchup, mustards, relishes, evaporated milk, condensed milk, corn syrups, maple syrups, honey, mayonnaise, salad dressings, dipping sauces, barbeque sauces, spreads, jams, jellies;

E) Baking supplies such as: vanillas, food coloring, extracts, flavor syrups (kirsch);

F) Alcoholic Beverages such as: beer, wine, liqueurs and alcoholic spirits;

G) Other Beverages such as: milk, water, pop drinks, fruit juices, vegetable juices, sodas, lemon juice, lime juice, flavor drink syrups;

H) p Automotive Liquids such as: windshield washer, motor oil, lubricating oils, multi-surface cleaning formulas, hand cleaners, waxes, paint, all purpose cleaners, paints;

I) Pet supplies such as: pet shampoo, liquid bird food, litter spray;

J) Art supplies such as: paints, various glues, paint thinners;

K) Deco supplies such as: paints, paint removers;

L) Medicines supplies such as: heartburn, cold/flu multi-symptom relieve, vitamins;

M) Other Miscellaneous Liquids such as: liquid plant food, flower food.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A bulk dispensing system comprising a plurality of bulk liquid dispensing devices, each bulk liquid dispending device being provided in combination with a portable liquid container having a discharge opening, and each device comprising:

a main frame;

a primary tank fixed on the main frame having a discharge opening at a bottom end and an inlet opening at a top end and being arranged for containing a bulk liquid therein;

a dispenser nozzle supported below the primary tank in communication with the discharge opening of the primary tank;

a control valve in series with the dispenser nozzle so as to be arranged to control dispensing of the bulk liquid from the primary tank through the dispenser nozzle;

a secondary tank support arranged to support the portable liquid container thereon above the primary tank; and a liquid conduit arranged for sealed connection with the discharge opening of the portable liquid container at an upper end and arranged for sealed connection with the inlet opening of the primary tank at a lower end so as to be arranged for communicating bulk liquid from the portable liquid container to the primary tank;

the secondary tank support and the liquid conduit both being arranged such that the portable liquid container is readily separable from the primary tank and interchangeable with a different portable liquid container of like configuration;

wherein the bulk dispending system further comprises a common payment system in communication with all of the bulk liquid dispensing devices so as to be arranged to associate a debit amount with the prescribed amount of bulk liquid of each user selection and arranged to debit from a customer a common debit amount corresponding to a cumulative total of the debit amounts.

2. The bulk dispensing system according to claim 1 wherein the liquid conduit of each device is arranged for unrestricted communication of liquid from the portable liquid container to the primary tank.

3. The bulk dispensing system according to claim 1 wherein there is provided a vent line in communication with the primary tank of each device having an open free end arranged to be supported higher in elevation than the portable liquid container supported on the secondary tank support.

4. The bulk dispensing system according to claim 1 wherein the primary tank of each device is arranged to controllably dispense liquid therefrom through the control valve when the portable liquid container is separated from the primary tank.

5. The bulk dispensing system according to claim 1 wherein the portable liquid container of each device is generally rectangular in shape and is adapted to be handled with pallet moving equipment.

6. The bulk dispensing system according to claim 1 wherein there is provided a shut-off valve in series with the liquid conduit of each device.

7. The bulk dispensing system according to claim 1 wherein the primary tank of each device is arranged for communication with the portable liquid container and the dispenser nozzle such that liquid is arranged to be dispensed from the portable liquid container to the primary tank and from the primary tank through the dispenser nozzle solely under force of gravity.

8. The bulk dispensing system according to claim 1 wherein there is provided a container receiving area below the dispenser nozzle of each device arranged to support an auxiliary container therein and a container sensor in the container receiving area arranged to determine a volume of the auxiliary container in the container receiving area.

9. The bulk dispensing system according to claim 1 wherein there is provided a flow meter arranged to determine a prescribed volume of liquid dispensed from the dispenser nozzle of each device.

10. The bulk dispensing system according to claim 1 wherein there is provided a container supporting surface below the dispenser nozzle of each device upon which a customer container is arranged to be supported and wherein the dispenser nozzle is adjustable in height relative to the container supporting surface.

11. The bulk dispensing system according to claim 10 wherein there is provided a guard assembly including a guard member supported at a location spaced below a bottom end of the dispenser nozzle of each device which includes a locating opening in alignment with the dispenser nozzle thereabove, the guard member being arranged to engage a top end of the customer container about a neck opening of the customer container so as to being arranged to guide alignment of the dispenser nozzle with the neck opening while preventing contact of the dispenser nozzle with the customer container.

12. The bulk dispensing system according to claim 11 wherein the guard assembly and the dispenser nozzle of each device are movable together relative to the container supporting surface.

13. A bulk dispensing system comprising a plurality of bulk liquid dispensing devices, each bulk liquid dispending device being provided in combination with a portable liquid container having a discharge opening, and each device comprising:

a main frame;

a primary tank fixed on the main frame having a discharge opening at a bottom end and an inlet opening at a top end and being arranged for containing a bulk liquid therein;

a dispenser nozzle supported below the primary tank in communication with the discharge opening of the primary tank;

a control valve in series with the dispenser nozzle so as to be arranged to control dispensing of the bulk liquid from the primary tank through the dispenser nozzle;

a secondary tank support arranged to support the portable liquid container thereon above the primary tank; and a liquid conduit arranged for sealed connection with the discharge opening of the portable liquid container at an upper end and arranged for sealed connection with the inlet opening of the primary tank at a lower end so as to be arranged for communicating bulk liquid from the portable liquid container to the primary tank;

the secondary tank support and the liquid conduit both being arranged such that the portable liquid container is readily separable from the primary tank and interchangeable with a different portable liquid container of like configuration;

wherein the plurality of bulk liquid dispensing devices are arranged in a row; and wherein the bulk dispensing system further comprises:

a conveyor system arranged for conveying portable liquid containers along the row of devices at an elevation above the primary tanks; and a common lift system arranged to lift portable liquid containers onto the conveyor system.

14. A bulk liquid dispensing system for dispensing bulk liquids into respective portable liquid containers, the system comprising:

a plurality of bulk liquid dispensing devices, each device comprising:

a main frame;

a primary tank fixed on the main frame having a discharge opening at a bottom end and an inlet opening at a top end and being arranged for containing a bulk liquid therein;

a dispenser nozzle in communication with the discharge opening of the primary tank; and a control valve in series with the dispenser nozzle so as to be arranged to control dispensing of a prescribed amount of bulk liquid from the primary tank through the dispenser nozzle in response to a user selection; and a common payment system in communication with all of the bulk liquid dispensing devices so as to be arranged to:

associate a debit amount with the prescribed amount of bulk liquid of each user selection; and debit from a customer a common debit amount corresponding to a cumulative total of the debit amounts;

wherein the common payment system comprises a computer implemented selection tool arranged to:

receive the user selections from the customer in which each user selection comprises a type of bulk liquid and the prescribed amount of bulk liquid associated therewith; and assign a unique identification to the customer in association with the user selections in response to payment of the common debit amount by the customer;

each bulk liquid dispensing device being associated with one respective type of bulk liquid and including a user interface arranged to receive unique identifications input from the customers so as to be arranged to dispense the prescribed amount of bulk liquid in response to receipt of the associated unique identification corresponding to the type of bulk liquid associated with that dispensing device.

15. The system according to claim 14 wherein the payment system comprises a plurality of customer identifications associated with respective customers and wherein the payment system is arranged to associate the respective debit amount to the customer identification of the customer when the prescribed amount of bulk liquid is dispensed from each dispensing device in response to the associated user selection being made at the device.

16. The system according to claim 14 wherein the computer implemented selection tool further comprises an internet interface permitting a customer to make user selections remotely from the dispensing devices through an internet connection.

17. The system according to claim 14 wherein the computer implemented selection tool comprises a computer application which is arranged to be executed on a smartphone or a tablet in communication with the common payment system.

18. The system according to claim 14 wherein the computer implemented selection tool is arranged to generate a single unique identification associated with all of the user selections of the respective common debit amount.

* * * * *